US006755671B1

(12) United States Patent
Fan et al.

(10) Patent No.: US 6,755,671 B1
(45) Date of Patent: Jun. 29, 2004

(54) ELECTRICAL CONNECTOR HAVING IMPROVED GROUND STRUCTURE

(75) Inventors: Chia Hao Fan, Tu-Chen (TW); Ming-Lun Kuo, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 33 days.

(21) Appl. No.: 10/631,408

(22) Filed: Jul. 30, 2003

(30) Foreign Application Priority Data

May 5, 2003 (TW) ..... 92208188 U

(51) Int. Cl.[7] ..... H01R 13/648

(52) U.S. Cl. ..... 439/108; 439/607; 439/563; 439/564; 439/569

(58) Field of Search ..... 439/567, 607, 439/609, 108, 563, 569, 565

(56) References Cited

U.S. PATENT DOCUMENTS 4,629,278 A 12/1986 Norton et al.
5,125,853 A 6/1992 Hashiguchi ..... 439/607
5,344,342 A 9/1994 Briones
5,401,189 A 3/1995 Sato ..... 439/607
5,709,556 A 1/1998 Tan et al.
6,386,910 B1 5/2002 Yu ..... 439/567
2002/0168893 A1 11/2002 Kasahara

*Primary Examiner*—Ross Gushi
*Assistant Examiner*—Briggitte R. Hammond
(74) *Attorney, Agent, or Firm*—Wei Te Chung

(57) ABSTRACT

An electrical connector (1) includes an insulative housing (10) defining a number of passageways (123), a number of electrical terminals (20) received in the passageways of the insulative housing, a metallic shell (30) assembled to the insulative housing, and a retention structure (40). The insulative housing includes a pair of support portions (13). The metallic shell includes a pair of contacts plates (36) deposited on the two support portions of the insulative housing. The retention structure is stamped and formed from sheet metal and mounted to the support portions of the insulative housing. The retention structure abuts against the contact plates of the metallic shell to electrically connect therebetween.

17 Claims, 4 Drawing Sheets

ELECTRICAL CONNECTOR HAVING IMPROVED GROUND STRUCTURE

CROSS-REFERENCES TO RELATED APPLICATIONS

This application is related to a contemporaneously filed U.S. patent application entitled "ELECTRICAL CONNECTOR HAVING IMPROVED RETENTION STRUCTURE", which is invented by the same inventor and assigned to the same assignee as this application.

BACKGROUND OF THE INVENTION

1. Field of the Invention

The present invention relates to an electrical connector, and particularly to an electrical connector mountable to a substrate such as a printed circuit board.

2. Description of Related Art

In personal computers, electrical connectors are often mounted to printed circuit boards for electrically connecting the printed circuit boards with other devices. The electrical connectors usually include some locking or retention structures to hold the electrical connectors to the printed circuit boards and exterior metallic or conductive shells connecting with ground traces on the printed circuit boards to be protected from EMI (Electro-Magnetic Interference).

In order to simplify the assembly of the electrical connectors to the printed circuit boards, the metallic shells often connect with the ground traces on the printed circuit boards by the retention structures. A number of methods for achieving a reliable electrical connection between the metallic shells and the retention structures are known in the art. A first conventional method consists of stamping and forming a metallic shell and a retention structure into a single unit. However, the first conventional method suffers from a disadvantage that manufacturing of the metallic shell and the retention structure as a single piece is complicated and costly, consequently a special treatment for an insulative housing of the electrical connector is needed.

In a second conventional method described in U.S. Pat. Nos. 5,344,342 and 5,709,556, a retention structure is joined to a metallic shell by bolts and nuts, thereby providing an electrical connection between the retention structure and the metallic shell. The result is assembly of the electrical connector requires the use of the bolts, which causes lower performance efficiencies of the assembly. In addition, the configuration of the retention structure is complicated.

Hence, an electrical connector having improved metallic shell and retention structure is desired.

SUMMARY OF THE INVENTION

An object of the present invention is to provide an electrical connector having new metallic shell and retention structure which connect with each other simply and reliably.

To achieve the above object, an electrical connector in accordance with the present invention comprises an insulative housing defining a plurality of passageways, a plurality of electrical terminals received in the passageways of the insulative housing, a metallic shell assembled to the insulative housing, and a retention structure. The insulative housing comprises a pair of support portions. The metallic shell comprises a pair of contact plates deposited on the two support portions of the insulative housing. The retention structure is stamped and formed from sheet metal and mounted to the support portions of the insulative housing. The retention structure abuts against the contact plates of the metallic shell to electrically connect therebetween Other objects, advantages and novel features of the invention will become more apparent from the following detailed description when taken in conjunction with the accompanying drawings.

DETAILED DESCRIPTION OF THE INVENTION

Figure 1:
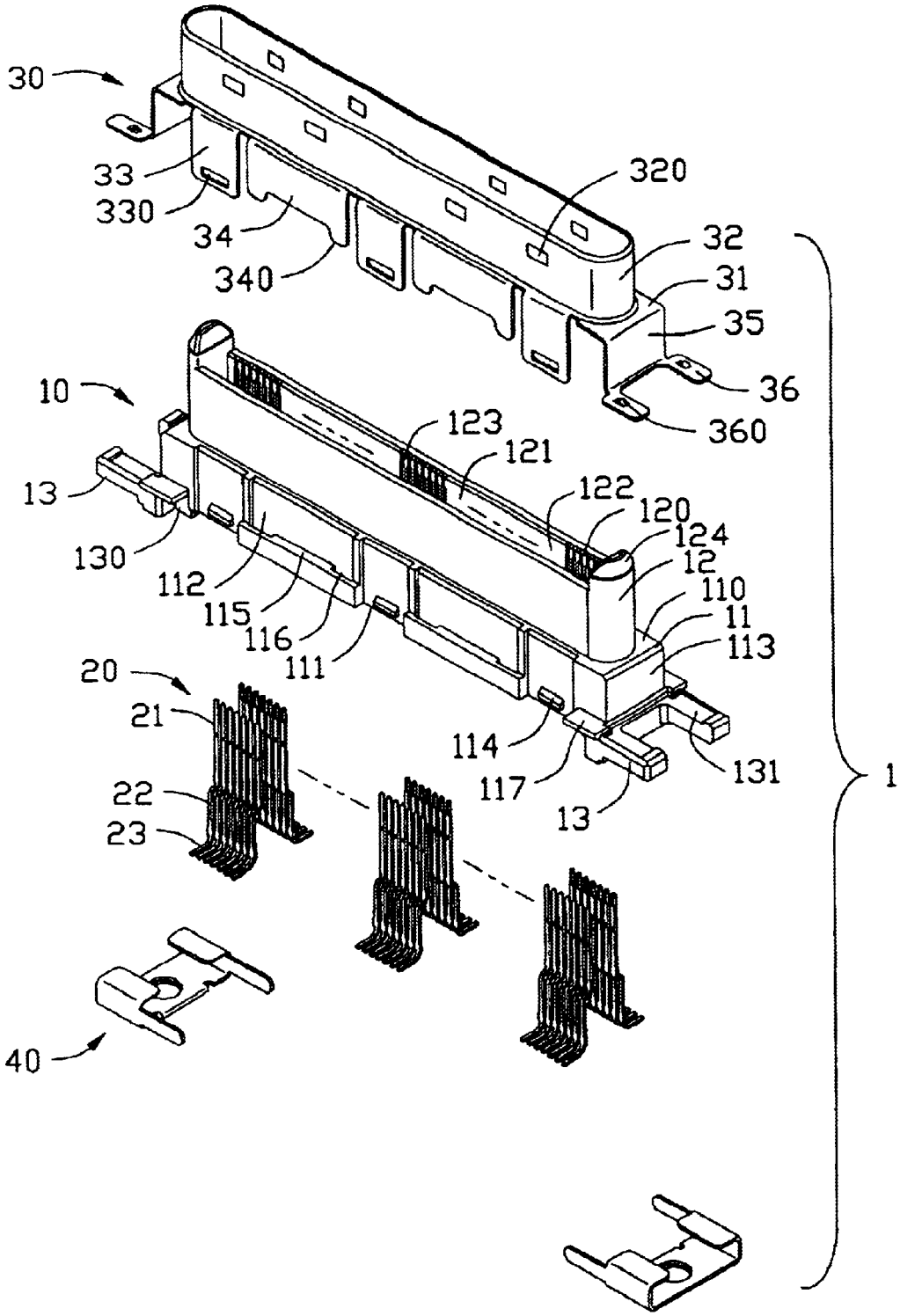
FIG. 1 is an exploded perspective view of an electrical connector in accordance with the present invention.

Referring to FIG. 1, an electrical connector 1 in accordance with the present invention comprises an insulative housing 10, a plurality of electrical terminals 20, a metallic shell 30, and a pair of retention structures 40.

The insulative housing 10 comprises an elongated base 11, a mating portion 12 and two pairs of support portions 13. The base 11 has an upper face 110, a bottom face 111 opposite to the upper face 110, two opposite side faces 112 and two opposite end faces 113. The mating portion 12 extends upwardly from the upper face 110 of the base 11 and defines a top face 120 and a slot 121 extending downwardly from the top face 120 along a longitudinal direction thereof. A plurality of passageways 123 are defined on two opposite side walls 122 of the slot 121. The passageways 123 extend downwardly through the base 11. A pair of guide posts 124 are provided on two opposite ends of the mating portion 12 and extend upwardly beyond the top face 120 of the mating portion 12.

The base 11 is formed with a plurality of projections 114 and flanges 115 on the two opposite side faces 112 thereof. Each flange 115 defines a pair of slits 116 on opposite ends thereof. The base 11 is formed with a pair of plates 117 extending outwardly from two opposite side faces 112 of each end thereof in a direction which is perpendicular to a longitudinal direction of the base 11. Each pair of support portions 13 extend outwardly from an end face 113 of the base 11 along the longitudinal direction of the base 11 and are spaced apart from each other. Each support portion 13 has an upper side, a lower side opposite to the upper side and an outer side. A pair of depressed portions 130 are formed under the pair of plates 117 and adjacent to the pair of support portions 13 on each end of the base 11. Each support portion 13 defines a groove 131 in the upper side thereof.

Each electrical terminal 20 comprises a contact portion 21, a retention portion 22 extending downwardly form the contact portion 21 and a tail portion 23 extending from the retention portion 22.

The metallic shell 30 comprises a main portion 31, a mating port 32 extending upwardly from the main portion 31, a plurality of latch tabs 33 and clips 34 extending downwardly from two opposite sides of the main portion 31, a pair of vertical plates 35 extending downwardly from two opposite ends of the main portion 31, a pair of contact plates 36 horizontally extending from a bottom end of each vertical plate 35. A plurality of projections 320 are stamped on two opposite side walls of the mating port 32. Each latch tab 33 has an opening 330. A pair of protrusions 340 project downwardly from two opposite ends of each clip 34. A resilient tab 360 is stamped from each contact plate 36 and extends upwardly and slantly.

Figure 2:
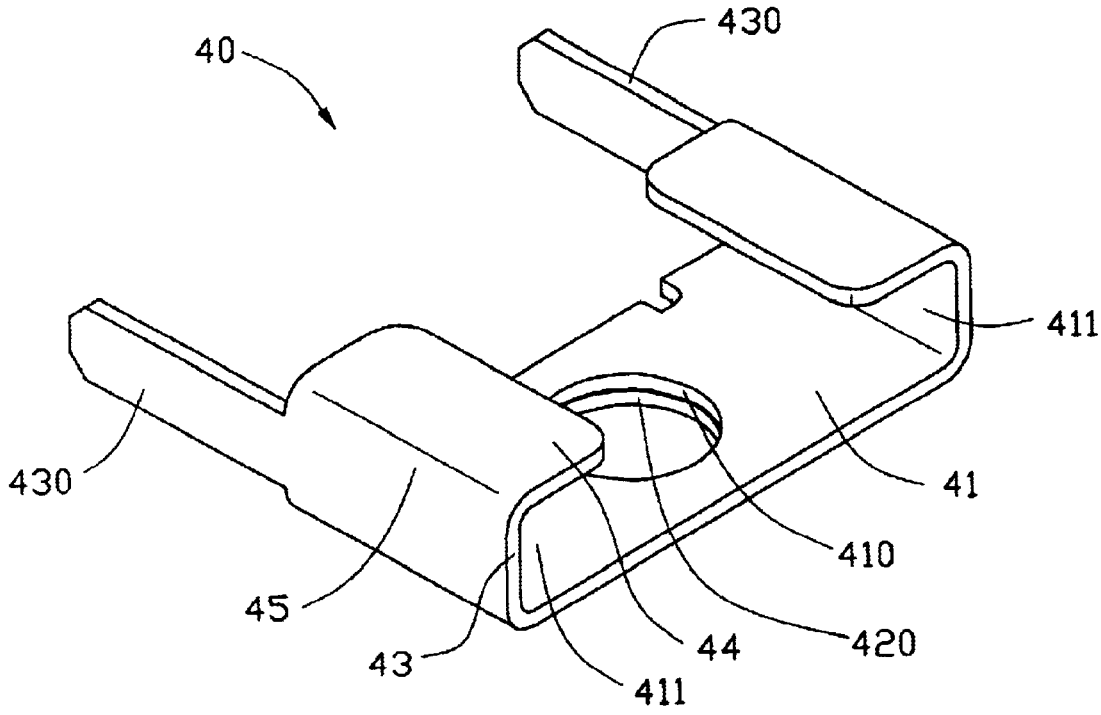
FIG. 2 is an enlarged perspective view of a retention structure of the electrical connector of FIG. 1.
Figure 3:
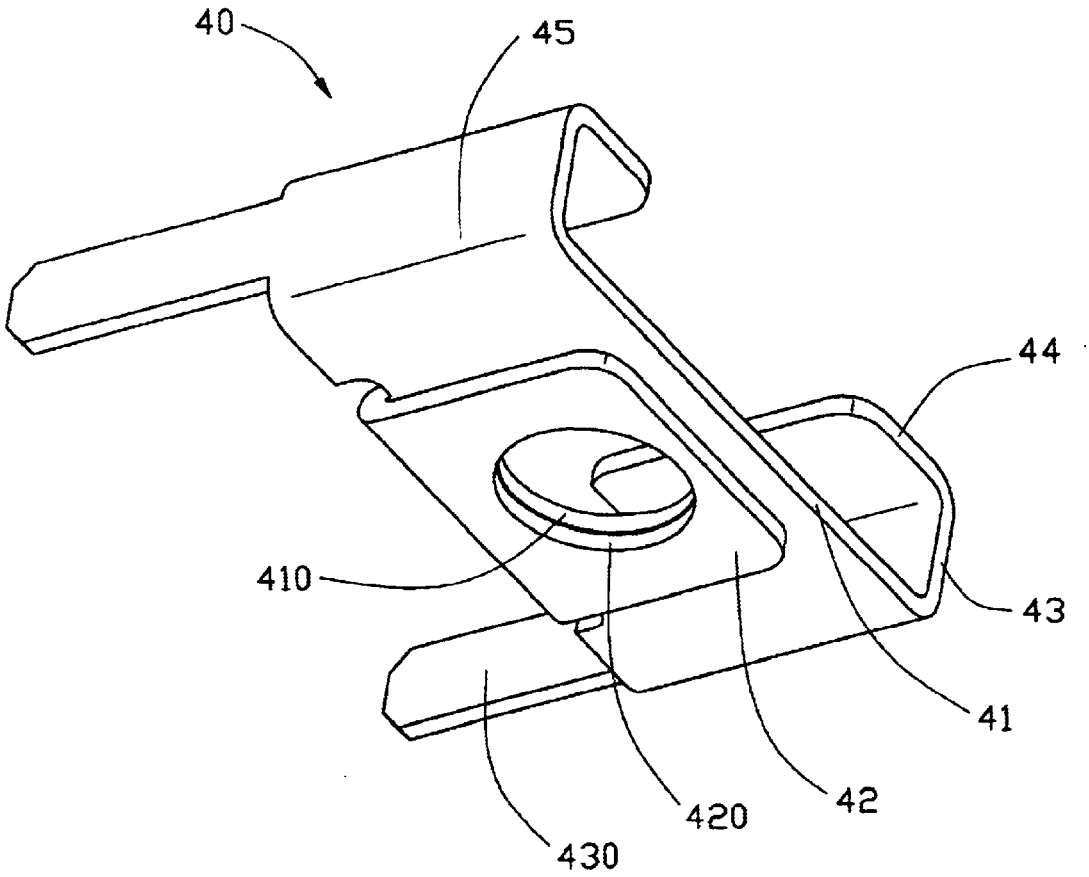
FIG. 3 is a view similar to FIG. 2 but taken from a different aspect.

Referring to FIGS. 2 and 3, the retention structures 40 are stamped and formed from sheet metal. Each retention structure 40 comprises a body portion 45 and a pair of extensions 430 extending from the body portion 45. The body portion 45 comprises a main plate 41 having a hole 410, a folded plate 42 bending downwardly from an inner side of the main plate 41 and extending outwardly, a pair of side portions 43 extending vertically and upwardly from two opposite sides of the main plate 41, and a pair of upper portions 44 extending horizontally toward each other from top ends of the two side portions 43 respectively. The folded plate 42 is substantially parallel to the main plate 41 and defines a hole 420 corresponding to the hole 410 of the main plate 41. The upper portions 44 are parallel to the main plate 41 to define a pair of receiving space 411 therebetween. The two extensions 430 extend inwardly from the two side portions 43 respectively.

Figure 4:
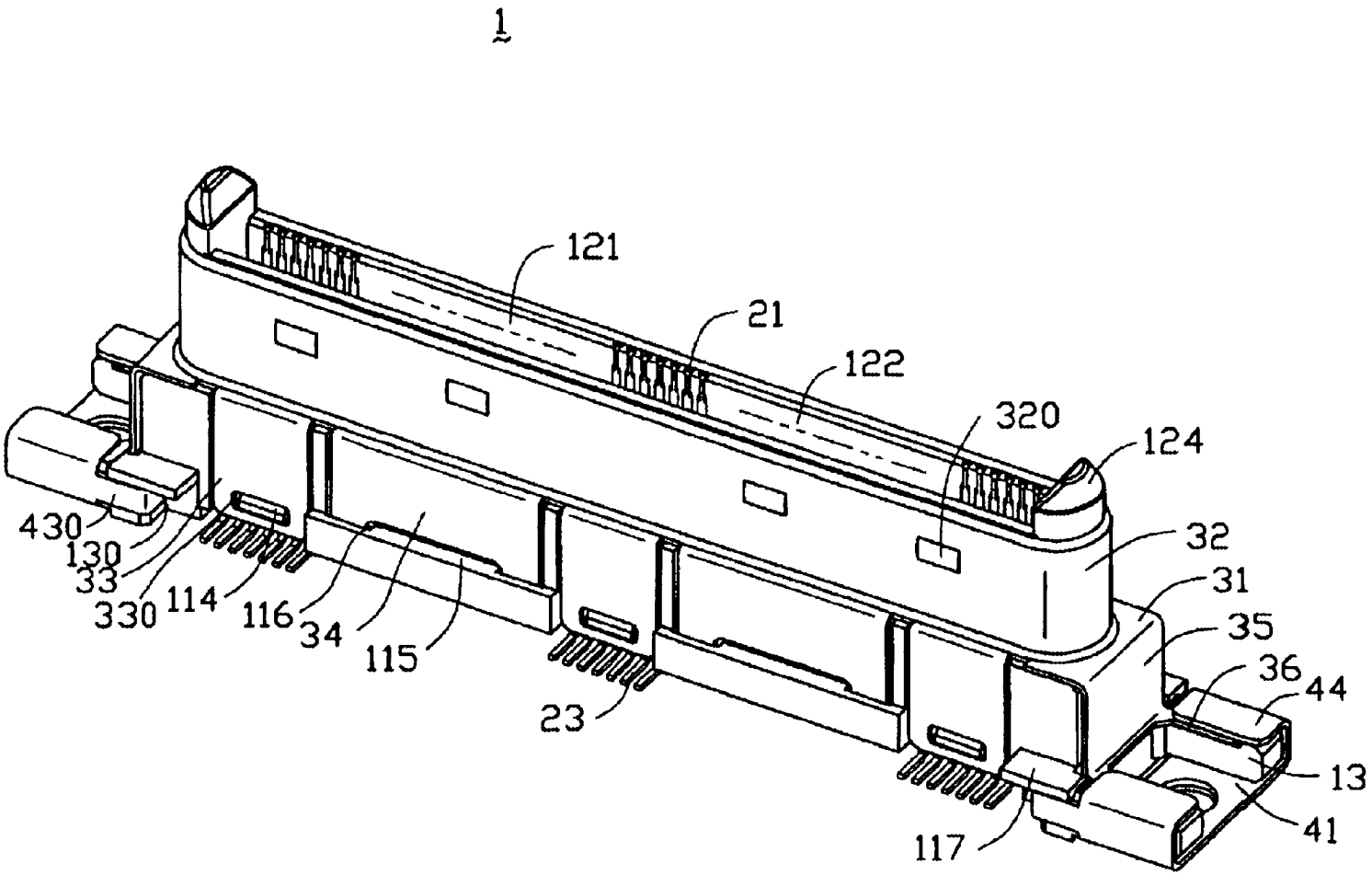
FIG. 4 is an assembled perspective view of the electrical connector of FIG. 1.

Referring to FIG. 4, in assembly, the electrical terminals 20 are assembled to the insulative housing 10 from the bottom face 111 of the base 11 with the contact portions 21 received in the passageways 123 on the two opposite side walls 122 of the slot 121, the retention portions 22 engaged with the base 11 and the tail portions 23 extending beyond the side faces 112 of the base 11. The metallic shell 30 is assembled to the insulative housing 10 with the mating port 32 surrounding the mating portion 12, the main portion 31 and the vertical plates 35 covering the upper face 110 and the end faces 133 of the base 11 respectively, the contact plates 36 received in the grooves 131 of the support portions 13. The latch tabs 33 and clips 34 extend downwardly along the side faces 112 of the base 11. The projections 114 engage with the openings 330 of the latch tabs 33 and the protrusions 340 of the clips 34 are received in the slits 116 of the flanges 115 to fix the metallic shell 30 to the insulative housing 10.

The retention structures 40 are assembled to the insulative housing 10 from two opposite ends of the base 11 along the longitudinal direction thereof. The support portions 13 are received in the receiving spaces 411 of the retention structures 40. The two upper portions 44 and the main plate 41 of each retention structure 40 clamp the upper and the lower sides of the pair of support portions 13 to prevent the retention structure 40 vertically move relative to the support portions 13. The two side portions 43 of each retention structure 40 clamp the outer sides of the pair of support portions 13 to prevent the retention structure 40 transversally move relative to the support portions 13. The extensions 430 are bent to engage with the depressed portions 130 of the insulative housing 10 to prevent the retention structures 40 from disengaging the support portions 13 in the longitudinal direction of the base 11. Therefore, the retention structures 40 are fixed to the insulative housing 10 reliably. The resilient tabs 360 abut against the upper portions 44 of the retentions structures 40 to electrically connect the metallic shell 30 and the retention structures 40. It should be noted that the contact plates 36 of the metallic shell 30 can abut against the upper portions 44 of the retention structures 40 directly without the resilient tabs 360.

It is important to note that the side portions 43 and the upper portions 44 can extend not vertically and horizontally respectively. The side portions 43 and the upper portions 44 can be configured to correspond to the support portions 13 of the insulative housing 10. For example, when the support portions 13 are cylindrical configuration, the side portions 43 and the upper portions 44 of the retention structures 40 are then formed to arc configuration to conform with the extensions 13. The pair of extensions 430 of each retention structure 40 can also extend inwardly from the main plate 41 or the two upper portions 44 respectively.

When the electrical connector 1 is mounted to a printed circuit board (not shown), screws (not shown) pass through the holes 410, 420 of the main plates 41 and of the folded plates 42 and the screw-holes in the printed circuit board to be fastened to the printed circuit board, so the electrical connector 1 is secured to the printed circuit board. The folded plates 42 connect ground traces on the printed circuit boards to achieve a reliable electrical connection between the metallic shell 30 the ground traces on the printed circuit board.

It is to be understood, however, that even though numerous characteristics and advantages of the present invention have been set forth in the foregoing description, together with details of the structure and function of the invention, the disclosure is illustrative only, and changes may be made in detail, espically in matters of shape, size, and arrangement of parts within the principles of the invention to the full extent indicated by the broad general meaning of the terms in which the appended claims are expressed.

What is claimed is:

1. An electrical connector comprising:

an insulative housing comprising a plurality of passageways and a pair of support portions spaced apart from each other;

a plurality of electrical terminals received in the passageways of the insulative housing;

a metallic shell assembled to the insulative housing and comprising a pair of contact plates extending on the two support portions of the insulative housing; and a retention structure stamped and formed from sheet metal and mounted to the support portions of the insulative housing, the retention structure abutting against the contact plates of the metallic shell to electrically connect therebetween wherein the insulative housing comprises an elongated base having an upper face, a bottom face opposite to the upper face, two opposite side faces and two opposite end faces, and a mating portion extending upwardly from the upper face of the base and having a top face and the metallic shell comprises a main portion covering the upper face of the base, a mating port extending upwardly from the main portion and surrounding the mating portion of the insulative housing, a pair of vertical plates extending downwardly from two opposite ends of the main portion and covering the two opposite end faces of the base.

2. The electrical connector as claimed in claim 1, wherein the metallic shell comprises a plurality of latch tabs extending downwardly from two opposite sides of the main portion and along the two opposite side faces of the base, each latch tab having an opening, and wherein the base is formed with a plurality of projections on the two opposite side faces thereof and engaging with the opening of the latch tabs.

3. The electrical connector as claimed in claim 1, wherein the metallic shell comprises a plurality of clips extending downwardly from two opposite sides of the main portion and along the two opposite side faces of the base, each clip having a pair of protrusions projecting downwardly from two opposite ends thereof, and wherein the base is formed with a plurality of flanges on the two opposite side faces thereof, each flange defining a pair of slits on opposite ends thereof to receive the protrusions of the clips.

4. The electrical connector as claimed in claim 1, wherein the mating portion is provided with a pair of guide posts on two opposite ends thereof and extending upwardly beyond the top face thereof.

5. The electrical connector as claimed in claim 1, wherein the insulative housing comprises a second pair of support portions extending therefrom, and wherein the electrical connector comprises a second retention structure mounted to the second pair of support portions.

6. The electrical connector as claimed in claim 1, wherein each support portion has an upper side, a lower side opposite to the upper side, an outer side and a groove defined in the upper side, and wherein the contact plates extend outwardly from one of the vertical plates along a longitudinal direction and are received in the grooves of the support portions.

7. The electrical connector as claimed in claim 6, wherein the retention structure comprises a body portion having a main plate, a pair of side portions extending upwardly from two opposite sides of the main plate, and a pair of upper portions extending toward each other from the pair of the side portions, the two upper portions and main plate clamping the upper and the lower sides of the two support portions of the insulative housing, the two side portions clamping the outer sides of the two support portions.

8. The electrical connector as claimed in claim 7, wherein each contact plate has resilient tab extending therefrom and abutting against the upper portion of the retention structure.

9. The electrical connector as claimed in claim 7, wherein the base is formed with a pair of plates extending outwardly from two opposite side faces thereof on an end of the insulative housing in a direction which is perpendicular to a longitudinal direction of the base and a pair of depressed portions under the pair of plates and adjacent to the pair of support portions, and wherein the retention structure comprises a pair of extensions extending from the two side portions thereof and being bent to engage with the pair of depressed portions.

10. The electrical connector as claimed in claim 7, wherein the main plate defines a hole.

11. The electrical connector as claimed in claim 10, wherein the body portion comprises a folded plate bending downwardly from an inner side of the main plate and extending outwardly, the folded plate being substantially parallel to the main plate and defines a hole corresponding to the hole of the main plate.

12. The electrical connector as claimed in claim 1, wherein the mating portion defines a slot extending downwardly form the top face along a longitudinal direction thereof, and wherein the passageways are defined on two opposite side walls of the slot and extend downwardly through the base.

13. The electrical connector as claimed in claim 12, wherein each electrical terminal comprises a contact portion received in the passageway, a retention portion extending downwardly from the contact portion and engaging with the base, and a tail portion extending from the retention portion and beyond the side face of the base.

14. An electrical connector comprising:

an insulative housing defining an elongated base with two pairs of support portions respectively extending outwardly at two opposite ends thereof along a lengthwise direction;

a plurality of terminals disposed in the base;

a metallic shell assembled to the housing with two pairs of contact plates respectively abutting against the corresponding support portions;

a pair of retention structures attached to the corresponding pairs of support portions, respectively, each of said retention structures cooperating with the corresponding support portions to protectively engageably sandwich the corresponding contact plates therebetween for grounding wherein each of said retention structures defines a pair of receiving spaces compliantly receiving the corresponding support portions and contact plates therein, respectively.

15. The connector as claimed in claim 14, wherein each of said retention structures defines a drawer-like configuration and is assembled to the corresponding pair of support portions along said lengthwise direction.

16. The connector as claimed in claim 14, wherein each of said support portions defines a groove receiving the corresponding contact plate therein.

17. The connector as claimed in claim 14, wherein said pair of contact plates extend from a lower portion of a vertical plate which abuts against an end wall of the base.

* * * * *